US005419010A

United States Patent [19]

Mullet

[11] Patent Number: 5,419,010

[45] Date of Patent: May 30, 1995

[54] COMPACT COUNTERBALANCING SYSTEM FOR SECTIONAL DOORS

[75] Inventor: Willis Mullet, Pensacola Beach, Fla.

[73] Assignee: Wayne-Dalton Corp., Mt. Hope, Ohio

[21] Appl. No.: 56,190

[22] Filed: May 3, 1993

[51] Int. Cl.[6] ..... E05D 13/00; E05F 11/54

[52] U.S. Cl. ..... 16/198; 160/191

[58] Field of Search ..... 16/198, DIG. 1; 160/191; 242/107

[56] References Cited

U.S. PATENT DOCUMENTS

| | | | |
|---|---|---|---|
| 965,940 | 8/1910 | Ritter . | |
| 1,058,824 | 4/1913 | Whitmore | 16/198 |
| 1,154,432 | 9/1915 | Rawlings et al. | 16/198 |
| 1,342,751 | 6/1920 | McCloud . | |
| 1,378,123 | 5/1921 | Lovejoy . | |
| 1,454,125 | 5/1923 | McHarg . | |
| 1,465,695 | 8/1923 | Stewart . | |
| 1,470,977 | 10/1923 | Heintz | 16/198 |
| 1,508,886 | 9/1924 | Dautrick et al. . | |
| 1,530,762 | 3/1925 | Dautrick . | |
| 1,621,669 | 3/1927 | Johnson . | |
| 1,724,995 | 8/1929 | Dautrick . | |
| 1,750,042 | 3/1930 | Hoover . | |
| 1,827,433 | 10/1931 | Kendall . | |
| 1,886,490 | 11/1932 | Lynch . | |
| 1,938,978 | 12/1933 | Rush . | |
| 1,940,485 | 12/1933 | Beeman et al. . | |
| 1,941,574 | 1/1934 | Nichols . | |
| 1,946,970 | 2/1934 | Grandgent . | |
| 1,992,006 | 2/1935 | Greegor | 16/198 |
| 1,994,142 | 3/1935 | Madsen | 16/198 |
| 2,010,214 | 8/1935 | Braun | 16/198 |
| 2,017,012 | 10/1935 | Morgan . | |
| 2,020,831 | 11/1935 | Greegor . | |
| 2,023,909 | 12/1935 | Wread . | |
| 2,037,085 | 4/1936 | Naylor . | |
| 2,059,833 | 11/1936 | Winn, Jr. | 16/198 |
| 2,093,019 | 9/1937 | Norberg . | |
| 2,099,191 | 11/1937 | Blodgett . | |
| 2,166,746 | 7/1939 | Bartel . | |
| 2,183,495 | 12/1939 | Laufersweiler | 160/191 |
| 2,226,017 | 12/1940 | Pixley | 16/198 |
| 2,257,484 | 9/1941 | Rowe | 16/198 |
| 2,294,360 | 9/1942 | Blodgett | 16/198 |
| 2,314,015 | 3/1943 | Parsons | 16/198 |
| 2,605,100 | 7/1952 | Matchett . | |
| 2,630,597 | 3/1953 | Robinson | 16/198 |
| 2,749,570 | 6/1956 | Alder | 16/198 |
| 2,786,231 | 3/1957 | Robinson | 16/197 |
| 2,855,162 | 10/1958 | Schacht, Jr. | 242/117 |
| 3,096,815 | 7/1963 | May | 160/188 |
| 3,160,200 | 12/1964 | McKee et al. | 160/189 |
| 3,165,143 | 1/1965 | Jackwig | 160/189 |
| 3,412,423 | 11/1968 | Binns | 16/198 |
| 3,413,680 | 12/1968 | Rowe et al. | 16/198 |
| 3,616,575 | 11/1971 | Harris | 49/200 |
| 3,635,277 | 1/1972 | Bahnsen | 160/191 |

(List continued on next page.)

*Primary Examiner*—Lowell A. Larson
*Assistant Examiner*—Donald M. Gurley
*Attorney, Agent, or Firm*—Renner, Kenner, Greive, Bobak, Taylor & Weber

[57] ABSTRACT

A counterbalancing mechanism (10) for a door (D) movable between a dosed position proximate a door frame (12) and an open position displaced therefrom including a pair of drums (100, 100) for reeving lengths of cable (C) thereabout which are affixed to the door (D), shafts (70) for freely rotatably mounting the drums thereon, a pair of brackets (60, 60) mounted in spaced relation on the door frame, one of the brackets supporting each of the pair of shafts, a drive tube (30) extending between the pair of drums and being non-rotatably affixed thereto, a coil spring (80) positioned interiorly of the drive tube, said coil spring having one end (82) thereof non-rotatably affixed to the drive tube and the other end (81) non-rotatably affixed to the shaft, and a tension adjusting mechanism (110) for normally restraining the shafts and for effecting rotation of the shafts to selectively adjust the torsional forces in the coil spring.

23 Claims, 6 Drawing Sheets

OTHER PUBLICATIONS

| | | | |
|---|---|---|---|
| 3,842,892 | 10/1974 | Stieler | 160/133 |
| 3,921,761 | 11/1975 | Votroubek et al. | 185/39 |
| 3,934,635 | 1/1976 | Kin | 160/189 |
| 4,001,969 | 1/1977 | Hoobery | 49/95 |
| 4,047,441 | 9/1977 | Kellogg | 74/52 |
| 4,472,910 | 9/1984 | Iha | 49/139 |
| 4,731,905 | 3/1988 | Milano et al. | 16/306 |
| 4,757,853 | 7/1988 | Price | 160/191 |
| 4,817,927 | 4/1989 | Martin | 267/155 |
| 4,852,378 | 8/1989 | Greco | 72/379 |
| 4,882,806 | 11/1989 | Davis | 16/198 |
| 4,885,872 | 12/1989 | Chang et al. | 49/362 |
| 4,930,182 | 6/1990 | Eichenberger | 16/198 |
| 4,981,165 | 1/1991 | Miller et al. | 160/191 |
| 5,010,688 | 4/1991 | Dombrowski et al. | 49/362 |
| 5,036,899 | 8/1991 | Mullet | 160/189 |
| 5,103,890 | 4/1992 | Cloutier | 160/190 |

COMPACT COUNTERBALANCING SYSTEM FOR SECTIONAL DOORS

TECHNICAL FIELD

The present invention relates generally to a counterbalancing system for sectional doors. More particularly, the present invention relates to a counterbalancing system for sectional doors which move in and out of position relative to a vertical opening. More specifically, the present invention relates to a compact counterbalancing system for use in conjunction with multi-section doors which are movable from a horizontal position to a vertical position in proximity to a door frame, particularly in circumstances where there is minimal clearance between a door frame and the overhead or suspended elements in the area where the door reposes in its storage position.

BACKGROUND ART

Counterbalancing systems for sectional doors have been employed for many years. Common examples of such sectional doors are the type employed as garage doors in homes, commercial and utility buildings, and similar applications. Counterbalancing systems originally solved the need for providing mechanical assistance in the instance of very large doors for commercial installations and smaller garage doors for residential use, which were normally constructed of heavy, relatively thick wood or metal components. More recently, counterbalancing systems have been increasingly used to permit opening and closing operations by a single person and to facilitate the use of electric motors, preferably of limited size, to power the opening and closing of such doors.

Most such counterbalancing systems utilize drums which carry cables attached to the garage door. Commonly the drums are mounted above the frame defining the door opening, with a drum positioned at each end of the door such that the cables may be conveniently connected proximate the lower lateral corners of the garage door. Basically, the door is moved toward the dosed position, blocking the door opening due to gravity acting on the door as it moves from a substantially horizontal, open position above and inwardly of the door frame to a closed position. The path of the door in opening and closing is commonly defined by a track arrangement which interacts with rollers attached to the various sections of the door. The cable drums are classically interconnected with springs in a wide variety of ways so that they are progressively loaded as the door is lowered to prevent uncontrolled descent of the door and employ stored energy to assist in raising the door during subsequent opening operation.

The prevailing type of counterbalancing system for garage doors for homes normally having a seven-foot high door involves the utilization of torsion springs mounted on a shaft which is coaxial with or mounts the drums. In such systems, it is established practice to utilize cable drums having a diameter of approximately 3½ inches to 4 inches. A torsion spring or springs mounted outwardly of the shaft has a diameter normally in excess of 1½ inches to maintain an appropriate spring index. The drums and spring are normally mounted on a tubular shaft having a diameter of approximately 1 inch, which holds the springs and transmits torque from the springs to the drums which are attached to the tubing.

These conventional torsion counterbalancing systems require that the tube mounting the drums be positioned above the horizontal track of the door to permit raising the door as high in the door opening as possible to accommodate higher vehicles and to otherwise make optimum use of the door opening. With a counterbalancing system thus positioned and employing conventional 3½ to 4-inch cable drums, there is a requirement that there be a minimum of 13 to 14 inches above the door opening as overhead clearance to permit the mounting of these counterbalancing systems. However, a disadvantage of these conventional systems is the increasing requirement for a counterbalancing system which can be installed in a structure having a lesser overhead clearance. Frequently, construction parameters dictate a lower ceiling within a garage or the use of beams, supports, or other objects which do not provide the necessary headroom clearance of 13 to 14 inches required for the utilization of these conventional counterbalancing systems.

In an attempt to accommodate the requirements for decreased overhead clearance, efforts have been made to modify these conventional counterbalancing systems. If the drums and tube with the mounted springs are merely moved downwardly, one or more of these elements interfere with the door during its opening and closing motion. One alternative which has been employed to solve reduced headroom requirements is to move the drums outboard or laterally of the tracks and lowered to a point that the springs and center bracket supporting the tube normally substantially medially thereof will just permit door clearance. This configuration, however, has serious limitations in that the cable binds the door to some extent due to the outward force applied during operation, and such is only effective to minimally reduce headroom clearance to a distance on the order of 12 inches.

A more drastic alternative to obtain additional headroom contemplates the movement of the entire counterbalance system to the rear of the horizontal track, i.e., inwardly of the garage to a position proximate the extremities of the horizontal track where the top of the door reposes when it is in the open position. In systems of this nature, it is necessary to route the cable by pulleys from the counterbalance system to the door frame and then to the door. Systems of this type have proven to be both inefficient and costly, while introducing a relatively large, unsightly mechanism centrally of a garage.

The aforedescribed conventional torsion spring counterbalancing systems also have the disadvantage that the weight of the spring members is such as to require the use of a support bracket which normally suspends the tubular shaft substantially medially between the drums. The stationary support bracket is also commonly employed as the stationary anchor for the torsion springs. The support bracket is attached to the door header or more commonly a special spring pad located on the garage wall thereabove. Since the stationary anchor associated with the support bracket undergoes torsional loading equal to the weight of the door, there is a constant potential for operational failure or damage and injury to installation and maintenance personnel. The torsional forces can also result in a loosening of the support bracket, loosening of the stationary spring anchor, a failure of a door opening header or spring pad, all of which can result in a quick and violent untensioning of torsion springs, thereby presenting the potential for damage or injury to any proximate objects.

Another disadvantage of such conventional torsion spring counterbalancing systems is the susceptibility to variations in balance of the door. With a drum diameter of approximately 4 inches, the drums revolve approximately seven times during an opening cycle of a 7-foot high door. As spring tension is lost through aging or extensive use, a highly noticeable variation in balance of the door is produced, as contrasted with systems which might have a lesser drum diameter and, therefore, rotate a greater number of times during opening and closing, such that the loading effect on a door is less for a given variation in spring tension. This same consideration makes it difficult to adjust the conventional 4-inch drum systems, since minute adjustments in spring tension can produce a substantial effect on a door.

DISCLOSURE OF THE INVENTION

Therefore, an object of the present invention is to provide a counterbalancing system for sectional doors which is highly compact and capable of being installed in relatively confined locations where there is a minimum of space surrounding the frame for a door opening. Another object of the present invention is to provide such a counterbalancing system which may be adapted for use with a variety of conventional sectional garage doors wherein the overhead clearance in the garage above the door opening is restricted. A further object of the present invention is to provide such a counterbalancing system, wherein the major components are substantially downsized in that elements such as the cable drums may be approximately one-half the diameter of the conventional drums normally employed in the industry on comparably sized doors.

Another object of the present invention is to provide a counterbalancing system for sectional doors in which the spring is mounted internally of the tubular shaft so as not to be outwardly exposed and subject to the environment and to provide for easier and faster replacement of broken springs. A further object of the present invention is to provide such a counterbalancing system wherein one extremity of each of the pair of springs employed is attached to gear shafts supported by brackets to either side of a door so that the torque of the springs is transmitted to the jamb structure outside the track and door opening for safety and accessibility. Yet another object of the present invention is to provide such a counterbalancing system wherein the center bracket, which may be mounted either on the top portion of the door jamb or a relatively vulnerable spring pad located on the garage wall, merely supports the weight of the drive tube springs and related components and does not experience torque loading.

Another object of the present invention is to provide a counterbalancing system for sectional garage doors wherein a pair of springs are employed, with each having one end thereof attached to spring perches which are axially freely movable within the spring tube and are thus free to adjustably float therein. A further object of the present invention is to provide such a counterbalancing system where the coils of the spring may be formed with a spacing which will accommodate a lengthening of the spring during tensioning while introducing only a minimum of frictional resistance. Still a further object of the present invention is to provide such a counterbalancing system wherein there is no necessity for set screws or drive pins, which can loosen or fail during operation, to transmit rotational forces between the springs and the other components directly or indirectly attached thereto. Still another object of the present invention is to provide such a counterbalancing system wherein the drive tube is mounted between the cable drums, with provision for sufficient clearance such that the drive tube floats to lessen frictional forces which might otherwise occur.

Still another object of the present invention is to provide a counterbalancing system for sectional doors wherein the length of the drive tube is equal to or less than the width of the door to be suspended such that the tube may be packaged in the same container as the door panels for ease of shipment and handling. Another object of the present invention is to provide such a counterbalancing system wherein the springs and worm gears are sized and configured such that they may be assembled at the time of manufacture, inserted into the drive tube, and shipped as an assembly. Still another object of the invention is to provide such a counterbalancing system which, in addition to its reduced size, may be of reduced weight, of reduced component size, of a reduced number of components, and an otherwise lower cost system. Still a further object of the present invention is to provide a counterbalancing system which is safe and easy to install, even without special tools, which is susceptible of adjustment to effect precise adjustments in spring tension operating on the door and is otherwise advantageous in terms of ease of assembly, operation, and repair.

In general, the present invention contemplates a counterbalancing mechanism for a door movable between a closed position proximate a door frame and an open position displaced therefrom including, a pair of drums for reeving lengths of cable thereabout which are affixed to the door, a pair of shafts for freely rotatably mounting the drums thereon, a pair of brackets mounted in spaced relation on the door frame, each one of the brackets supporting one of the pair of shafts, a drive tube extending between the pair of drums and being nonrotatably affixed thereto, a coil spring positioned interiorly of the drive tube, said coil spring having one end thereof non-rotatably affixed to the drive tube and the other end non-rotatably affixed to one of the shafts, and a tension adjusting mechanism for normally restraining the shaft and for effecting rotation of the shaft to selectively adjust the torsional forces in the coil spring.

PREFERRED EMBODIMENT FOR CARRYING OUT THE INVENTION

Figure 1:
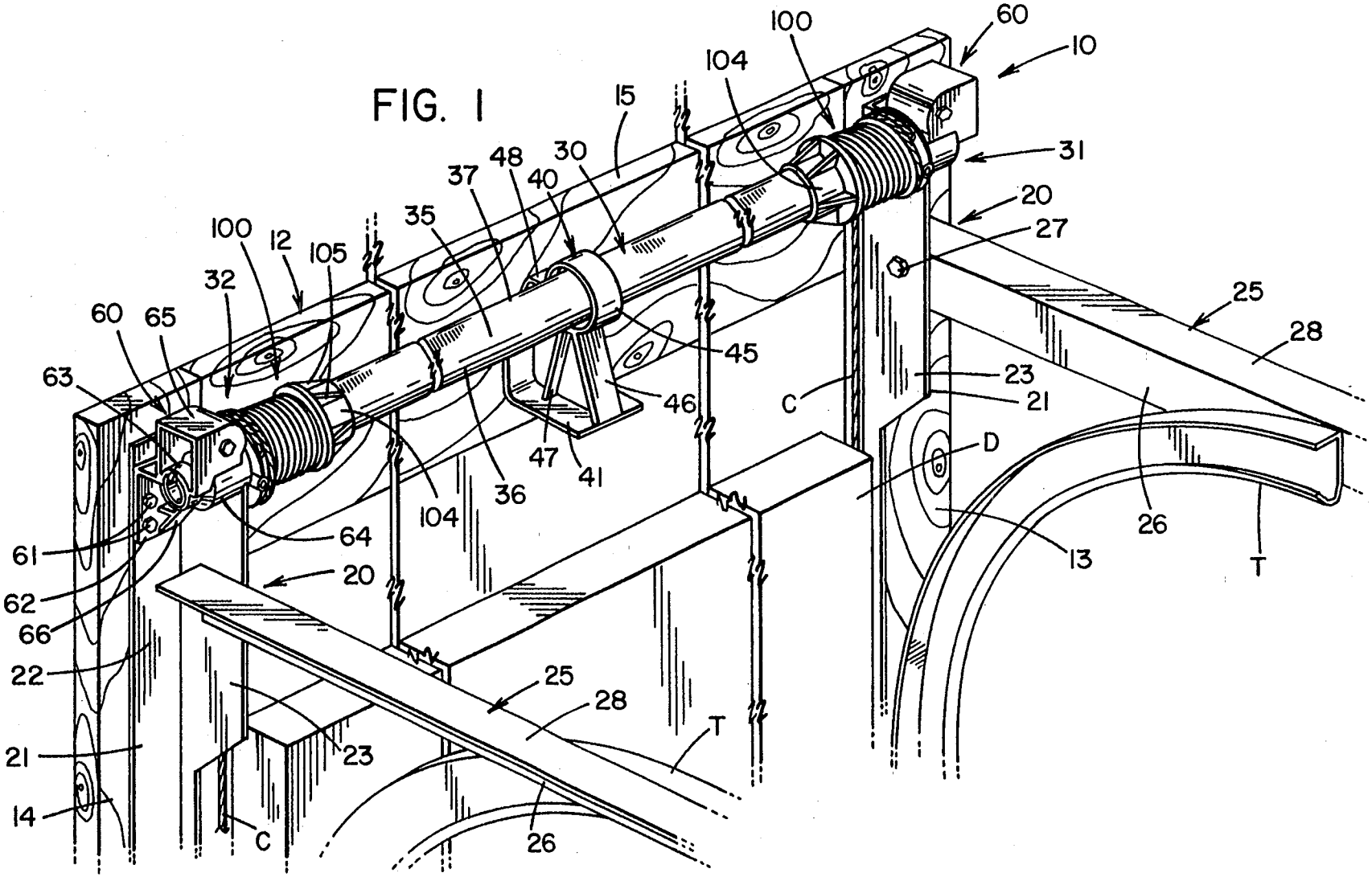
FIG. 1 is a fragmentary perspective view depicting a frame for a sectional door and showing a counterbalancing system embodying the concepts of the present invention as mounted in operative relationship to the door.

A counterbalancing system according to the concepts of the present invention is generally indicated by the numeral 10 in FIG. 1 of the drawings. The counterbalancing system 10 is shown mounted in conjunction with a conventional sectional door D of the type commonly employed in garages for homes. The opening in which the door is positioned for opening and closing movements relative thereto is surrounded by a frame, generally indicated by the numeral 12, which consists of a pair of spaced jamb members 13 and 14 that, as seen in FIG. 1, are generally parallel and extend vertically upwardly from the ground (not shown). The jambs 13, 14 are spaced and joined at their vertically upper extremity by a header 15 to thereby delineate a generally U-shaped frame 12 around the opening for a door D. The frame 12 is normally constructed of lumber, as is well known to persons skilled in the art, for purposes of reinforcement and to facilitate the attachment of elements supporting and controlling a door D, including the counterbalancing system 10.

Affixed to the jambs 13, 14 proximate the upper extremities thereof near the header 15 to either side of the door D are flag angles, generally indicated by the numeral 20. The flag angles 20, which may be of differing configurations, generally consist of L-shaped vertical members 21 having a leg 22 attached to an underlying jamb 13, 14 and a projecting leg 23 preferably disposed substantially perpendicular to the leg 22 and therefor perpendicular to the jambs 13, 14.

The flag angles 20 also include an angle iron 25 having a vertical leg 26, which may be attached to the projecting legs 23 of the vertical members 21 as by bolts 27. The angle irons 25 have stiffening legs 28. The angle irons 25 are positioned in supporting relation to the tracks T located to either side of a door D. The tracks T, T provide a guide system for rollers attached to the side of a door D, as is well known to persons skilled in the art. The angle irons 25 preferably extend substantially perpendicular to the jambs 13, 14 and may be attached to the transitional portion of tracks T, T between the vertical portion and horizontal portion thereof or in the horizontal portions of tracks T, T. The tracks T, as is well known, thus define the travel of the door D in moving from the open to closed positions and support a portion of the weight of the door D in the vertical and transition sections and substantially the entirety of the weight of the door in the horizontal sections.

The counterbalancing system 10 is positioned at or above the header 15. The counterbalancing system 10 includes an elongate drive tube, generally indicated by the numeral 30, extending between a tensioning assembly 31 and a tensioning assembly 32, which are positioned proximate the right side flag angle 20 and the left side flag angle 20, respectively.

Figure 5:
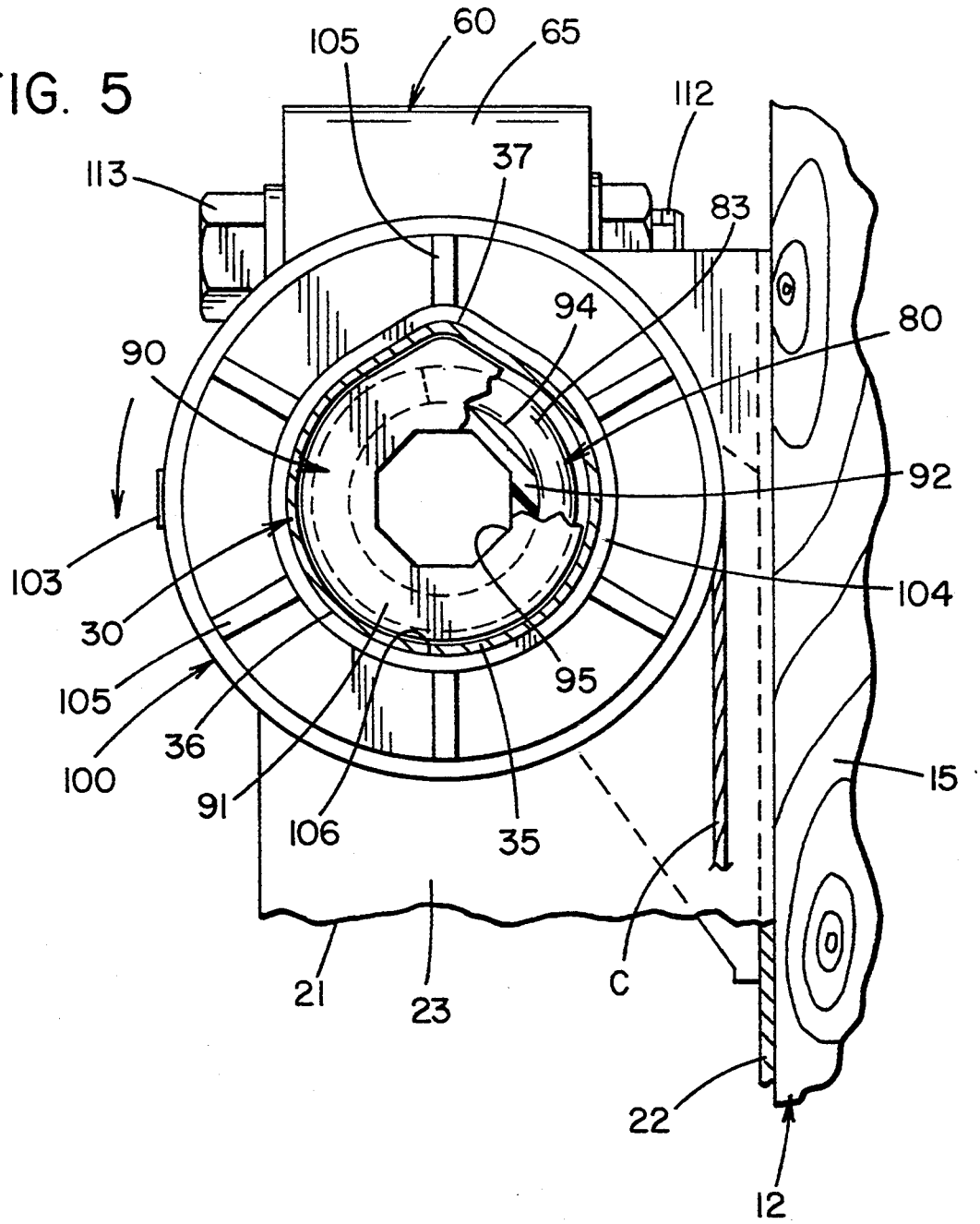
FIG. 5 is a cross-sectional view taken substantially along the line 5—5 of FIG. 4 and showing particularly the interrelation between the drive tube and the cable drum assembly.

The drive tube 30 is a hollow tubular member which is non-circular in cross section, as best seen in FIGS. 1 and 5. In the preferred form, the tubular member 35 has a circular portion 36 constituting a substantial portion of the circumference of tubular member 35. The remainder of tubular member 35 consists of a radially projecting cam lobe 37 which preferably extends axially the full length of the tubular member 35. The cam lobe 37 is configured such that the radial distance from the center of tubular member 35 to the radially outermost point of the cam lobe 37 is equal to or greater than the distance to the intersection of two sides of an eight or more sided polygon which might be circumscribed about a circle of the size of the circular portion 36 of tubular member 35. Alternatively, the tubular member 35 could be a polygon with less than seven sides. These exemplary configurations provide examples of a non-circular tubular member 35, such that internally or externally mating members cannot rotate relative to tubular member 35, as hereinafter described under the operating conditions encountered in use of the counterbalancing system 10.

Figure 2:
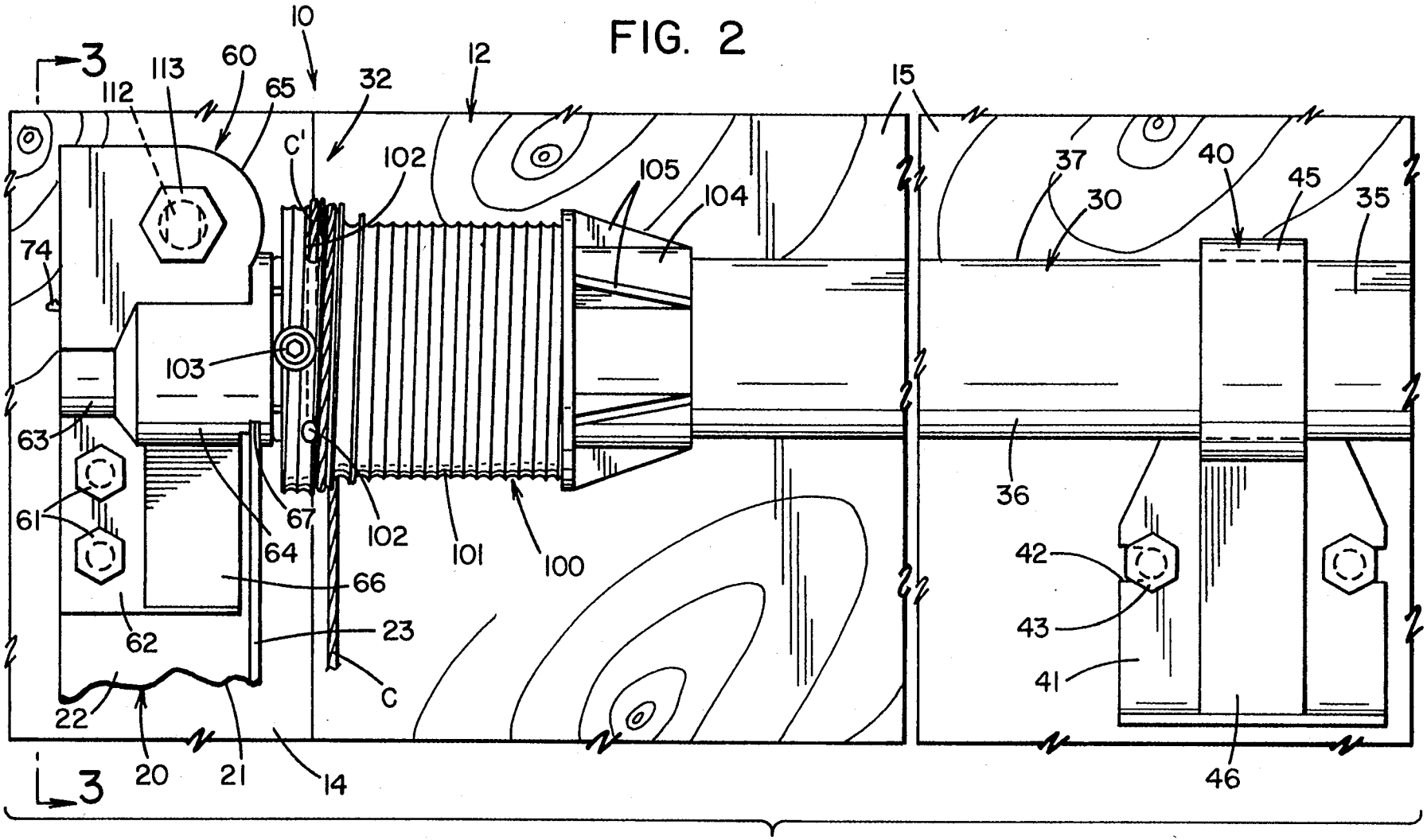
FIG. 2 is a fragmentary elevational view of the left-hand portion of the counterbalancing system of FIG. 1 as viewed from the inside of the sectional door.
Figure 4:
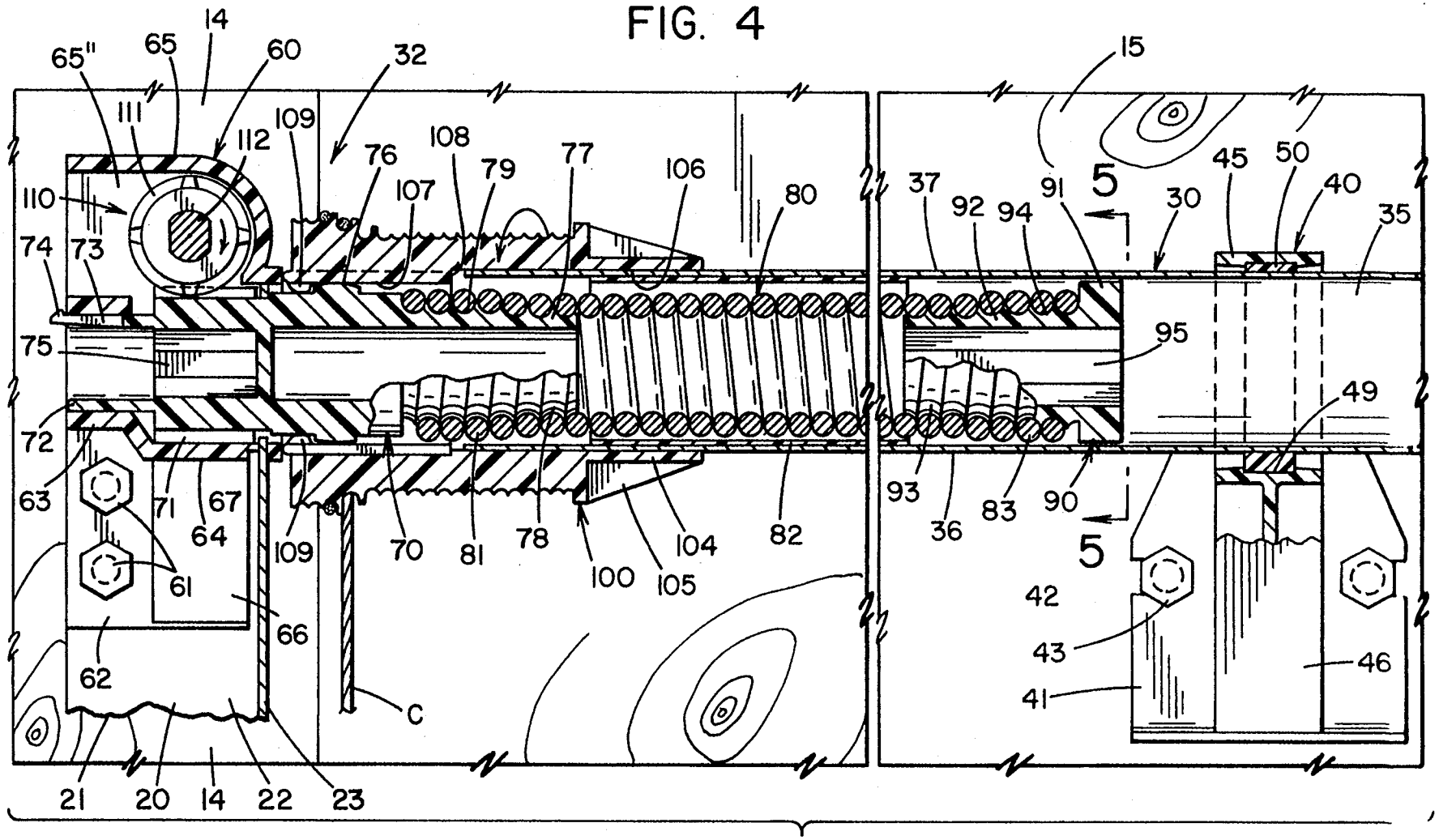
FIG. 4 is a cross-sectional view taken substantially along the line 4—4 of FIG. 3 and showing particularly details of the spring, the drive tube, the worm gear shaft, and the spring perch.

Depending upon the width of door D, the drive tube 30 may advantageously be supported substantially medially of its length by a center bracket, generally indicated by the numeral 40, as seen in FIGS. 1, 2, and 4 of the drawings. The center bracket 40 includes an L-shaped attachment plate 41 which may be provided with slots 42 or bores for receiving screws 43 to anchor the center bracket 40 to the header 15 or, depending upon the installation, a mounting pad affixed to the garage wall above the header 15.

The center bracket 40 has an annular journal box 45 which is spaced from and supported by attachment plate 41 by a plurality of struts 46, 47, and 48, which are preferably oriented substantially radially of annular journal box 45 (FIG. 1). The annular journal box 45 has a radial recess 49 positioned preferably substantially axially medially thereof. The recess 49 seats a bushing 50 which is affixed to the tubular member 35 of drive tube 30 (FIG. 4). The bushing 50 is interiorly contoured to the configuration to the tubular member 35, including the lobe 37, and externally circular to freely rotatably move within the recess 49 of the annular journal box 45.

The drive tube 30 interconnects at the ends thereof spaced from the center bracket 40 with the tensioning assemblies 31 and 32. Since the tensioning assemblies 31 and 32 are essentially identical, except that most components are symmetrically opposite, and since they function identically, only the tensioning assembly 32 is hereinafter described, as depicted in FIGS. 2–6 of the drawings.

Figure 3:
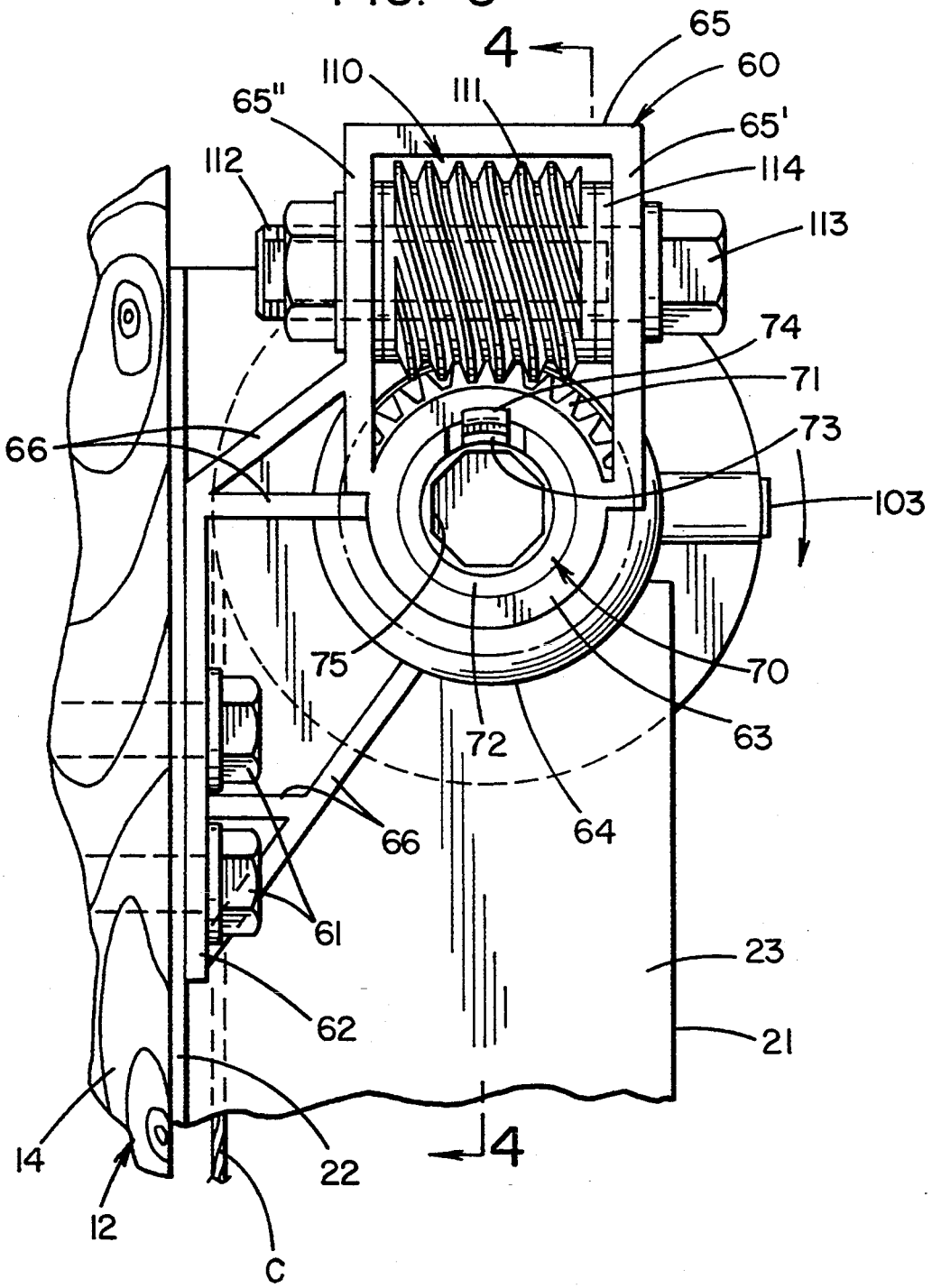
FIG. 3 is a side elevational view of the counterbalancing system taken substantially along the line 3—3 of FIG. 2 and depicting particularly the mounting bracket and its interrelation with the sectional door frame, together with the worm drive assembly for adjusting the tensioning assembly.

The tensioning assembly 32 has an end bracket, generally indicated by the numeral 60, to effect attachment to the flag angle 20 and/or the jamb 14 as by bolts 61 which extend through a backing plate 62 of the end bracket 60 (see FIG. 3). The end bracket 60 includes a tubular bearing box 63, a gear housing 64, and a worm shroud 65. As best seen in FIGS. 1 and 3, the worm shroud 65 may be a generally U-shaped enclosed member having spaced legs 65' and 65'' (FIG. 3) for a purpose to be hereinafter detailed. The tubular bearing box 63, gear housing 64, and worm shroud 65 are spaced and supported a distance from the plate 62 by a plurality of braces 66 (FIG. 3). The end bracket 60 may conveniently be provided with a slot 67 to receive the projecting leg 23 of flag angle 20. This serves to align and support the assembled counterbalancing system 10 while bolts 61 are installed to effect permanent placement.

The tensioning assembly 32 includes a gear shaft, generally indicated by the numeral 70, which interfits with the end bracket 60. The gear shaft 70 has a worm gear 71 formed therein which is positioned within the gear housing 64 of end bracket 60 (FIGS. 3 and 4). Extending axially in one direction from the worm gear 71 is a hollow sleeve 72, which is supported within the tubular bearing box 63 of end bracket 60. The sleeve 72 may terminate in one or more snap locks 73, which extend axially outwardly of and have a radially projecting lip 74 that overlies a portion of the axially outward surface of tubular bearing box 63 of end bracket 60. It will thus be appreciated that the end bracket 60 may be readily attached to the gear shaft 70 during installation of counterbalancing system 10 and particularly during the placement and attachment of the end bracket 60 to the jamb 14.

Radially inwardly of the worm gear 71 and accessible through the hollow sleeve 72, the gear shaft 70 may have a bore 75 which may be of octagonal configuration to receive a comparably shaped tool to facilitate gripping of the gear shaft 70 to permit assembly and disassembly of the counterbalancing system 10 in a manner described hereinafter. The gear shaft 70 has spaced a distance axially of the worm gear 71 in the direction opposite the sleeve 72 a radially upstanding bearing surface 76. The bearing surface 76 serves a purpose to be described hereinafter.

The gear shaft 70 at the end opposite the sleeve 72 terminates in a spring receiver portion 77. The spring receiver portion 77 consists of a plurality of helical grooves 78 which may be formed at substantially the same pitch angle and diameter as the coil spring, generally indicated by the numeral 80, which reposes thereon. If desired, a number of helical grooves 79 may be of a slightly larger diameter in the area displaced from the end of gear shaft 70 to further facilitate the tension of the spring 80 thereon.

The coil spring 80 may be of uniform configuration from end to end and have a spacing between the coils of several hundredths of an inch for purposes of accommodating additional coils of the spring 80 which are present in the working area of the spring 80 when it is subjected to torsional loading as hereinafter described. The spring 80 has a spring end 81, which is mounted in the grooves 78, 79 of the spring receiver portion 77 of gear shaft 70. The spring end 81 may be threaded on receiver 77 with an appropriate tool inserted into the bore 75 to prevent rotation of gear shaft 70 during assembly and disassembly operations.

A spring liner 82 may be provided radially outwardly of the spring 80 in the working area of the spring 80, as seen in FIG. 4. The spring liner 82 may conveniently be positioned on the interior surface of the tubular member 35 of drive tube 30 and may be shaped to the internal configuration thereof. The spring liner 82 may be of any impact-resistant plastic material for purposes of damping possible spring chatter which may develop during rapid torsional loading or unloading of the spring 80.

Figure 6:
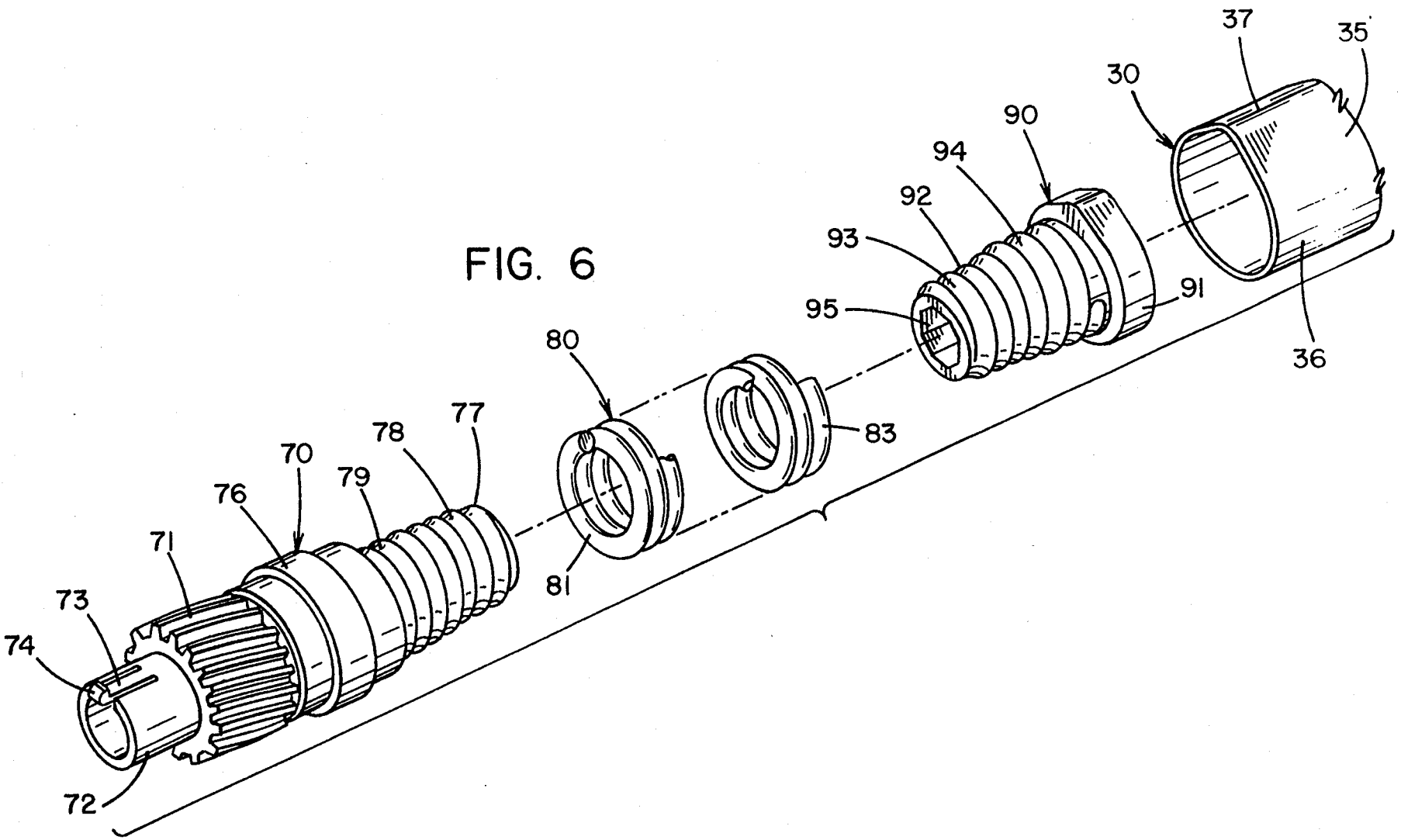
FIG. 6 is an exploded perspective view showing details of the worm gear shaft, the spring, the spring perch, the drive tube, and the interrelation therebetween.

Spring 80 has a spring end 83 at the opposite axial extremity from spring end 81 which engages a spring perch, generally indicated by the numeral 90. The spring perch 90 has a body portion 91 which, as seen in FIGS. 4 and 6, is externally configured for matingly engaging the inner surface of tubular member 35. The spring perch 90 has a spring receiver portion 92 which extends axially from the body 91. The spring receiver 92 may be formed in a manner comparable to spring receiver 77 and having a plurality of helical grooves 93 and a plurality of helical grooves 94, which are of a slightly greater diameter than the grooves 93, to similarly facilitate retention of spring end 83 when positioned thereon, as depicted in FIG. 4. The spring perch 90 may have a bore 95 of octagonal cross section similar to the bore 75 of gear shaft 70, again for the purposes of facilitating non-rotational retention of spring perch 90 during the assembly and disassembly of spring end 83 thereon.

It will thus be appreciated that the spring perch 90, due to the configuration of the body 91, remains non-rotatably positioned relative to and within the drive tube 30, while being capable of floating or moving axially within drive tube 30 when the spring 80 is not under torsional loading. This permits the spring perch 90 to self-adjust axially of the drive tube 30 to accommodate the exact length of a coil spring 80.

The drive tube 30 carries at the extremity thereof proximate to the end bracket 60 and supported in part by worm shaft 70 a cable drum mechanism, generally indicated by the numeral 100. Referring particularly to FIGS. 2, 4, and 5, the cable drum mechanism 100 has an external surface over a substantial portion of its length consisting of continuous helical grooves 101. The helical grooves are adapted for reeving a suspension cable C thereabout. The cable C is attached at one end to a point on the door at substantially the bottom of the lowermost panel when a door D is in the closed position. The other end C′ of the cable C is affixed to the cable drum 100 for selective retention and release when a cable C is installed or replaced. In this respect, an angular bore 102 extends into the drum 100 preferably proximate one extremity of the helical grooves 101 and is sized to receive the cable C. A hex screw 103 is positioned in a tapped radial bore (not shown) which intersects with the bore 102. Thus, the hex screw 103 may be tightened to retentively engage end C′ of cable C and released by loosening the hex screw 103 to move end C′ of cable C from the bore 102. The end of cable drum 100 axially opposite the hex screw 103 has a projecting sleeve 104 which may be provided with a plurality of circumferentially-spaced reinforcing ribs 105.

The cable drum 100 has a central bore 106 extending through the sleeve 104 and preferably a substantial distance into the drum 100, which is configured to matingly engage the exterior surface of the tubular member 35 of drive tube 30. It will thus be appreciated that the cable drum 100 is non-rotatably affixed to, and therefore at all times rotates with, the drive tube 30. The axial end of cable drum 100 opposite the bore 106 has a bore 107 of lesser diameter which is adapted to matingly engage and ride upon the projecting bearing surface 76 of gear shaft 70. An extent of clearance may be provided between a shoulder 108 formed by the juncture of bores 106 and 107 and the extremity of the drive tube 30 at either end thereof, such that the drive tube 30 is capable of an extent of axial movement to avoid possible binding or frictional interference (FIG. 4).

The bore 107 of cable drum 100 may be provided with a plurality of circumferentially-spaced radially inwardly projecting teeth 109. The teeth 109 extend inwardly of the bearing surface 76 of gear shaft 70 for purposes of positioning cable drum 100 axially of gear shaft 70 during assembly and installation.

It will thus be appreciated by persons skilled in the art that the counterbalancing system 10, as depicted in FIGS. 1, 2, and 4, is shown in a position with the door in substantially the closed position and the spring 80 thus fully tensioned to apply counterbalancing forces to a door D. As a door D would be raised manually or by a powered operator (not shown), the spring 80 having one end fixed by the gear shaft 70 would rotate the spring perch 90 and thus the drive tube 30 which rotates the cable drum mechanism 100 to reeve the cable C onto the groove 101. The spring 80 is thus progressively untensioned as the door D moves upwardly into the open position. Subsequent lowering of the door D operates in a reverse fashion to progressively load spring 80 as the door D is lowered, such that the counterbalancing system 10 reaches substantially the configuration depicted in FIGS. 1, 2, and 4.

The spring 80 is non-rotatably restrained and suitably pretensioned by a tension adjusting mechanism, generally indicated by the numeral 110 in FIGS. 3 and 4 of the drawings. The tension adjusting mechanism 110 is enclosed within the worm shroud 65 of end bracket 60 for purposes of protection from dirt or foreign objects, safety, and appearance. The tension adjusting mechanism 110 includes a worm 111 of relatively short axial extent which engages the worm gear 71 of gear shaft 70. The worm 111 is mounted on a worm shaft 112 which extends through the spaced legs 65', 65" of the worm shroud 65 of end bracket 60 for positioning the worm 111 in operative relation to the worm gear 71.

The tension adjusting mechanism 110 and worm gear 71 are designed and configured such that the worm mechanism can be operated only by actuation of the head 113 of non-circular worm shaft 112 which rotates the worm 111. Worm 111 and worm gear 71 are designed in such a fashion that the worm gear 71 cannot rotate the worm 111 in the operating range of the counterbalancing system 10. This is effected in part by employing a lead angle on worm 111 and worm gear 71 to provide increased friction, thus decreasing the operating efficiency thereof. A lead angle of approximately 11 to 14 degrees has been found to be sufficient to meet these operating parameters for systems involving doors in the size range herein contemplated. If desired in particular installations, a fiber washer 114 may be positioned proximate the worm 111 to provide additional friction and increase anti-reversing friction to assure that worm gear 71 does not drive worm 111 under any operating circumstances. It will be appreciated that the rotational position of gear shaft 70 remains fixed at all times during operation of the counterbalancing system 10, except when the head 113 of worm shaft 112 is rotated. It will be further appreciated that tensioning adjustments may be readily made by using a conventional hex socket and drill to rotate the head 113 in the desired direction to effect a selected pretensioning of the spring 80.

Thus, it should be evident that the counterbalancing system 10 for a sectional door D disclosed herein carries out various of the objects of the present invention set forth above and otherwise constitutes an advantageous contribution to the art. As will be apparent to persons skilled in the art, modifications can be made to the preferred embodiments disclosed herein without departing from the spirit of the invention. For example, it will be appreciated that only one of the tensioning assemblies 31, 32 might be employed, as with only an end bracket 60, gear shaft 70, and cable drum 100 being provided at one end, to supply the entirety of the torsional forces for the counterbalancing system 10. The scope of the invention herein described shall be limited solely by the scope of the attached claims.

I claim:

1. A counterbalancing mechanism for a door movable between a closed position proximate a door frame and an open position displaced therefrom comprising, a pair of drum means for reeving lengths of cable thereabout which are affixed to the door, a pair of shaft means each freely rotatably mounting one of said drum means thereon, a pair of bracket means mounted in spaced relation on the door frame, each of said bracket means supporting one of said pair of shaft means, drive tube means extending between said pair of drum means and being non-rotatably affixed thereto and axially movable therebetween, coil spring means positioned interiorly of said drive tube means, said coil spring means having one end thereof non-rotatably affixed to said drive tube means and the other end non-rotatably affixed to said shaft means, and means normally restraining said shaft means against rotation and effecting rotation of said shaft means to selectively adjust the torsional forces in said coil spring means while continuously restraining said shaft means against rotation.

2. A counterbalancing mechanism according to claim 1, wherein said drive tube means is non-circular in cross section and said pair of drum means have apertures which are of mating non-circular cross section.

3. A counterbalancing mechanism according to claim 2, wherein said other end of said coil spring means is non-rotatably affixed to said shaft means by spring perch means having a peripheral configuration which is a mating non-circular cross section to said non-circular cross section of said drive tube means.

4. A counterbalancing mechanism according to claim 1, wherein said drive tube means has a radially outwardly extending cam lobe in cross section.

5. A counterbalancing mechanism according to claim 4, wherein said drive tube means has the radial distance from the center of said drive tube to the radially outermost point of said cam lobe equal to or greater than the distance to the intersection of two sides of a eight or more sided polygon circumscribed about a circle of the size of the circular portion of said drive tube means.

6. A counterbalancing mechanism according to claim 4, wherein said cam lobe extends substantially the entire axial extent of said drive tube means.

7. A counterbalancing mechanism for a door movable between a closed position proximate a door frame and an open position displaced therefrom comprising, a pair of drum means for reeving lengths of cable thereabout which are affixed to the door, a pair of shaft means each freely rotatably mounting one of said drum means thereon, a pair of bracket means mounted in spaced relation on the door frame, each of said bracket means supporting one of said pair of shaft means, drive tube means extending between said pair of drum means and being non-rotatably affixed thereto, a pair of coil spring means positioned interiorly of said drive tube means, each of said coil spring means having one end thereof non-rotatably affixed to and axially movable relative to said drive tube means and the other end non-rotatably affixed to one of said pair of shaft means, and means normally restraining each of said pair of shaft means against rotation and permitting independent rotation of each of said pair of shaft means to selectively adjust the torsional forces in each of said pair of coil spring means while continuously restraining each of said pair of shaft means against rotation.

8. A counterbalancing mechanism according to claim 7, wherein said drive tube means is non-circular in cross section.

9. A counterbalancing mechanism according to claim 7, wherein said drive tube means has a radially projecting cam lobe, said drum means have mating configurations for engaging said cam lobe to preclude relative rotation therebetween and including spring perch means attached to said one end of said coil spring means and having mating configurations for engaging said cam lobe to preclude relative rotation therebetween.

10. A counterbalancing mechanism according to claim 7, wherein said means for normally restraining each of said pair of shaft means include worm gear means on each of said pair of shaft means and worm means attached to said bracket means in operative relation to each of said worm gear means for selectively rotating each of said pair of shafts while continuously restraining said shaft means against rotation.

11. A counterbalancing mechanism according to claim 10, including means for frictionally engaging said worm means.

12. A counterbalancing mechanism according to claim 10, wherein the lead angles of said worm gear means and said worm means preclude said worm gear means from driving said worm means.

13. A counterbalancing mechanism according to claim 12, wherein said lead angles of said worm gear means and said worm means are approximately 11 to 14 degrees.

14. A counterbalancing mechanism according to claim 7, wherein said shaft means have receiver means for non-rotatably seating said spring means and bearing surface means for supporting said drum means.

15. A counterbalancing mechanism according to claim 14, wherein said drum means have circumferentially-spaced teeth means extending radially inwardly of said bearing surface means for positioning said drum means axially of said shaft means.

16. A counterbalancing mechanism according to claim 7, wherein each of said coil spring means have each of the coils thereof spaced a distance from the adjacent coils when said coil means are untensioned.

17. A counterbalancing mechanism according to claim 7, wherein center bracket means supports said drive tube means substantially medially thereof.

18. A counterbalancing mechanism according to claim 17, wherein said center bracket means includes a journal box for receiving bushing means encircling said drive tube means.

19. A counterbalancing mechanism according to claim 18, wherein said bushing means has external configuration that is circular and an internal configuration that matingly engages the external configuration of said drive tube means.

20. A counterbalancing mechanism according to claim 7, wherein said bracket means are located on the door frame and rotatably support one of said pair of shaft means.

21. A counterbalancing mechanism for a door movable between a closed position proximate a door frame and an open position displaced therefrom comprising, a pair of drum means for reeving lengths of cable thereabout which are affixed to the door, each of said drum means having a non-circular bore, a pair of shaft means each freely rotatably mounting one of said drum means thereon, a pair of bracket means mounted in spaced relation on the door frame, each of said bracket means supporting one of said pair of shaft means, drive tube means having a non-circular cross section extending between said pair of drum means and engaging said bore of each of said drum means for rotating said drum means with said drive tube means while permitting axial movement of said drive tube means relative to said drum means, coil spring means positioned interiorly of said drive tube means, spring perch means in said drive tube means having a non-circular cross section inner engaging said non-circular cross section of said drive tube means for applying rotational forces to said drive tube means while permitting relative axial movement, said coil spring means having one end thereof non-rotatably affixed to said spring perch means and the other end non-rotatably affixed to said shaft means, and means normally restraining said shaft means against rotation and effecting rotation of said shaft means to selectively adjust the torsional forces in said coil spring means.

22. A counterbalancing mechanism according to claim 21, wherein said drive tube means has spring liner means positioned radially interiorly thereof and positioned radially exteriorly of said coil spring means.

23. A counterbalancing mechanism according to claim 22, wherein said spring liner means is a plastic tube which is shaped to conform to the internal configuration of said drive tube means.

* * * * *